US010926546B2

(12) United States Patent
Butinya et al.

(10) Patent No.: US 10,926,546 B2
(45) Date of Patent: Feb. 23, 2021

(54) DEFORMABLE FLUID SUPPLY

(71) Applicant: HEWLETT-PACKARD DEVELOPMENT COMPANY, L.P., Spring, TX (US)

(72) Inventors: David Butinya, Sant Cugat del Valles (ES); Pol Vinardell, Sant Cugat del Valles (ES); Marta Coma Vives, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/472,693

(22) PCT Filed: Apr. 24, 2017

(86) PCT No.: PCT/US2017/029169
§ 371 (c)(1),
(2) Date: Jun. 21, 2019

(87) PCT Pub. No.: WO2018/199899
PCT Pub. Date: Nov. 1, 2018

(65) Prior Publication Data

US 2019/0358959 A1 Nov. 28, 2019

(51) Int. Cl.

| | |
|---|---|
| ***B41J 2/175*** | (2006.01) |
| ***B41J 2/165*** | (2006.01) |
| ***B41J 2/18*** | (2006.01) |
| ***B41J 2/21*** | (2006.01) |

(52) U.S. Cl.
CPC ..... *B41J 2/175* (2013.01); *B41J 2/165* (2013.01); *B41J 2/18* (2013.01); *B41J 2/2107* (2013.01)

(58) Field of Classification Search
CPC .... B41J 2/175; B41J 2/17513; B41J 2/17596; B41J 2/17523; B41J 2/18; B41J 2/2107; B41J 2/165
See application file for complete search history.

(56) References Cited

U.S. PATENT DOCUMENTS

| | | | |
|---|---|---|---|
| 6,817,705 | B1 | 11/2004 | Crockett et al. |
| 8,348,399 | B2 | 1/2013 | Gengrinovich |
| 8,915,572 | B2 | 12/2014 | Levi |
| 9,039,155 | B2 | 5/2015 | Smith et al. |
| 9,457,568 | B2 | 10/2016 | Ikeda |

(Continued)

FOREIGN PATENT DOCUMENTS

EP 3000602 A1 3/2016

*Primary Examiner* — Jannelle M Lebron
(74) *Attorney, Agent, or Firm* — HP Inc. Patent Department

(57) ABSTRACT

Fluid supply apparatus 104 is disclosed. The fluid supply apparatus 104 comprises a first conduit 106 to supply fluid to a fluid dispense head and a second conduit 108 to receive fluid from the fluid dispense head. The first conduit 106 and second conduit 108 may both supply print fluid to a print head in a printing or servicing configuration. The first conduit 106 and the second conduit 108 are coupled together via a closable third conduit 116. The closable third conduit 116 permits fluid flow between the first conduit 106 and the second conduit 108. The third conduit 116 comprises deformable walls movable towards each other to close the third conduit 116 to the passage of fluid between the first 106 and second conduit 108.

18 Claims, 4 Drawing Sheets

(56) References Cited

U.S. PATENT DOCUMENTS

| | | | | |
|---|---|---|---|---|
| 2003/0132994 | A1* | 7/2003 | Samuels | B41F 31/08 347/85 |
| 2011/0018948 | A1 | 1/2011 | Justice et al. | |
| 2011/0242234 | A1 | 10/2011 | Jones | |
| 2016/0083604 | A1 | 3/2016 | Steert et al. | |
| 2017/0087868 | A1* | 3/2017 | Miyashita | B41J 2/18 |

* cited by examiner

DEFORMABLE FLUID SUPPLY

BACKGROUND

Printers that use print fluids with pigments, in particular heavy pigments (such as white print fluids comprising Titanium Oxide as a pigment or other metallic print fluids), may use various methods to keep the pigment dispersed both in the print head and in the print fluid delivery system. Some of these methods involve removing the print head from the carriage and storing it in a storage device, for example a shaker or rotational garage, to agitate the print fluid during storage to inhibit, to reduce and even to prevent print nozzles and other parts of the print head being occluded or partially occluded by precipitation of the heavy pigment.

BRIEF DESCRIPTION OF THE DRAWINGS

The following description is provided by way of example and with reference to the accompanying drawings, in which.

DESCRIPTION

Figure 1:
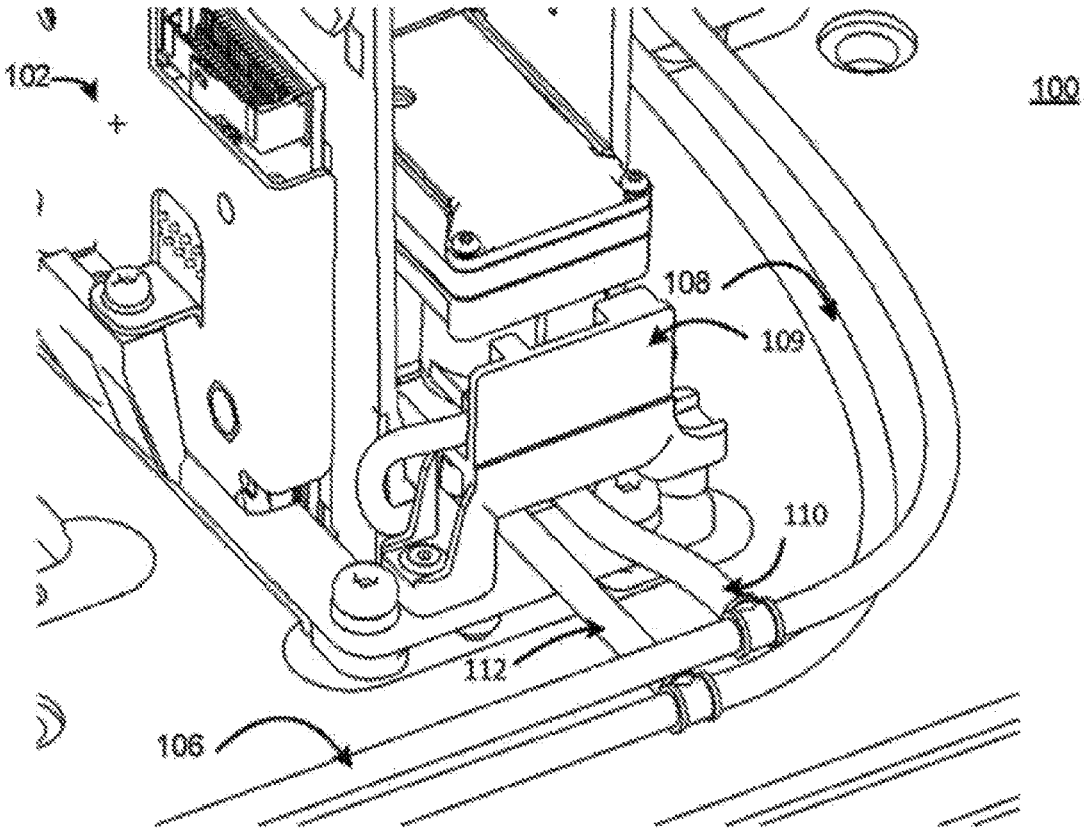
FIG. 1 is a schematic illustration of an example of a fluid supply apparatus with an interconnect bridge in situ with a print head from a first perspective.

In overview this disclosure concerns recirculating print fluid delivery systems for printers comprising a fluid interconnect that automatically connects the print fluid tubes that feed the print head needles when the print head is removed from the printer. Connecting the tubes that feed the print head needles when the print head is not present enables the print fluid in the print fluid delivery system to be recirculated which may assist to keep the pigment mixed, dispersed and ready for when the print head is installed back in the printer.

In previous approaches, closing the fluid interconnect has been achieved using electrovalves, that is to say electronically operated valves. This includes T-type fittings with an electrovalve that is activated if the print head is not present. However, electrovalves may be big and the space in the print head carriage may be restricted. Also, additional electronics and control circuitry may be used to control the electrovalves.

Another approach previously adopted has been the use of an external dummy print head that has both print head needles connected in order to close the print fluid loop.

However, in such an approach the print head is removed and the dummy print head placed in the carriage. If a user forgets to insert the dummy print head, the print fluid will not be moved as part of the recirculation process and the pigment may block the fluid interconnect. Additionally, since the dummy print head is an external part it is prone to being misplaced or create air ingestion to the print fluid delivery system each time that it is inserted. Also, the dummy print head may be stored in a shaker or rotation device when it is not used, as it also has print fluid with heavy pigment inside.

Considered in general outline, the present disclosure relates to a fluid supply apparatus, comprising a first conduit 808 to provide a first fluid communication pathway 813 to a fluid dispense head 802 and a second conduit 809 to provide a second fluid communication pathway 814 to the fluid dispense head 802. The first conduit 808 and the second conduit 809 are coupled together via a closable third conduit 816 to permit fluid flow between the first conduit 808 and the second conduit 809. The third conduit 816 comprises deformable walls which are movable towards each other to close 820 the third conduit 816 to the passage of fluid between the first 808 and second conduit 809.

Figure 8:
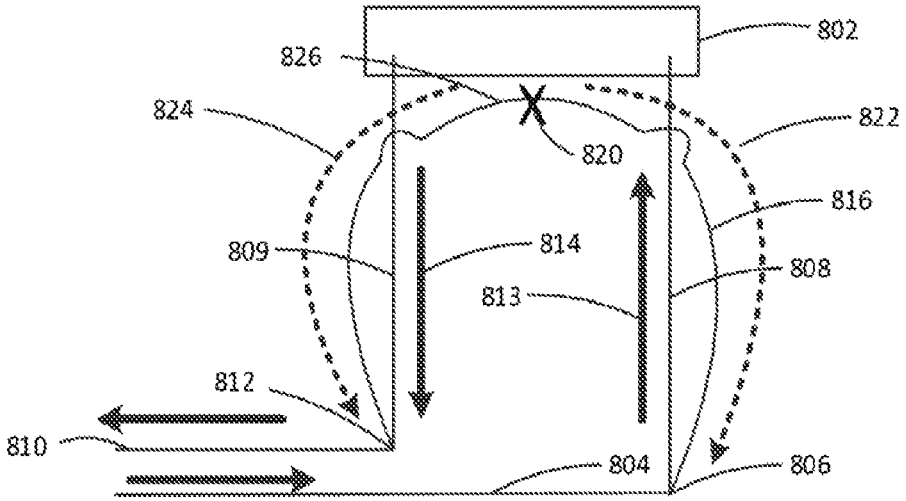
FIG. 8 is a schematic illustration of print fluid flow when an interconnect bridge is closed.

FIG. 8 illustrates print fluid flow when the third conduit 816 is closed 820. Print fluid may flow, solid arrow 813, to the print head 802 through the first conduit 808 from a print fluid pipe 804; and print fluid flow, solid arrow 814, from the print head 802 through the second conduit 809 to a print fluid pipe 810.

The disclosure also generally relates to a method of supplying fluid to a fluid dispense head, the method comprising providing respective fluid communication pathways to the fluid dispense head through a first fluid conduit and a second fluid conduit and coupling the first fluid conduit and the second fluid conduit via a interconnect conduit comprising deformable walls. The method further comprising deforming a wall of the interconnect conduit responsive to movement of the fluid dispense head to a position to be in fluid communication with the first and second fluid conduits.

In an example of the disclosure in which the fluid supply apparatus may be located in a carriage or chassis to support the fluid dispense head the space occupied in the carriage or chassis to accommodate the fluid supply apparatus may be less than previous approaches using electrovalves, for example. Electrovalves may take up additional space and themselves add weight to the carriage or chassis and additionally the weight of their electronics and cables. Carriage or chassis weight may influence fluid dispense throughput and operation of a device incorporating the carriage or chassis.

In at least one example, the fluid supply apparatus may be engageable with the fluid dispense head 802 to supply fluid to the fluid dispense head 802 in a fluid supply configuration and wherein in the fluid supply configuration a wall of the deformable walls is deformed responsive to a part of the fluid dispense head to close 820 the third conduit 816 to the passage of fluid.

The closure 820 of the third conduit 816 by deforming its walls may reduce or prevent air ingestion each time that the head is inserted or removed by avoiding placing external elements such as jumpers between the first and second conduits or inserting a dummy dispense head since the jumpers or dispense head can insert air in the fluid channel each time they are used.

In the fluid supply configuration the wall may be engageable with the part of the fluid dispense head to deform the wall to close the third conduit to the passage of fluid. The fluid supply apparatus may be disengageable from the fluid dispense head responsive to movement of the dispense head to a non-fluid supply configuration to release the wall of the deformable walls. An example of the present disclosure may avoid or even dispense with user intervention to close or open the third conduit. In such an example, when the fluid head is inserted or removed, the fluid path may change automatically as a consequence of the insertion or removal of the fluid dispense head. This may be compared with approaches utilising valves or external elements, such as jumpers or dummy dispense heads, in which users might overlook or forget to activate a valve or put the external hardware in place.

In an example of the disclosure, the third conduit 816 is coupled at a lower end 806, 812 of the first and second conduits in an operational orientation and fluid may flow to the lower end 806, 812, illustrated by broken line arrows 822 and 824, under the influence of gravity. The third conduit 816 may traverse a path between the first and second conduits 808, 809 comprising a single high point 826 in an operational orientation. The third conduit 816 being coupled at a lower end 806, 812 of the first and second conduits 808, 809 may assist in an example in which there is a single high point 826 as low points are defined. A single high point 826 may avoid or mitigate against pooling of fluid in the third conduit 816.

Figure 9:
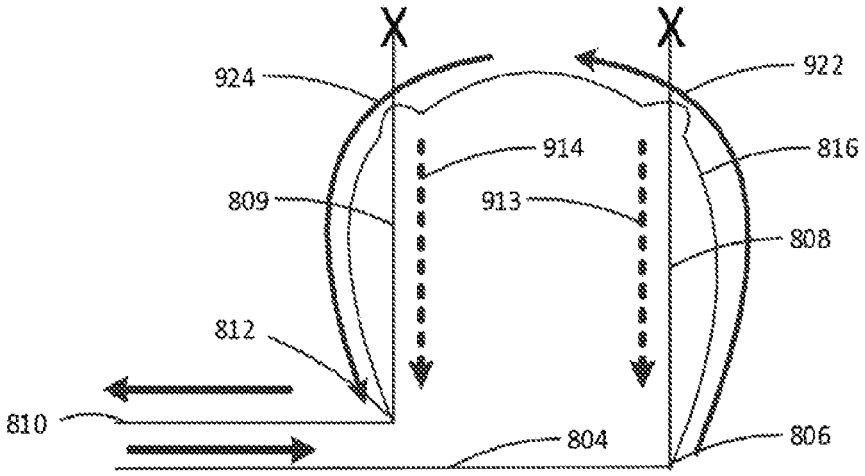
FIG. 9 is a schematic illustration of print fluid flow when an interconnect bridge is open.

FIG. 9 schematically illustrates fluid flow for a configuration in which the fluid dispense head 802 is removed and the third conduit 816 is open. The first conduit 808 and second conduit 809 are closed and fluid in the first conduit 808 and second conduit 809 tends to flow to the lower points 806 and 812 of the first conduit 808 and the second conduit 809 as illustrated by broken line arrows 913 and 914. Fluid is circulated through the system via the open third conduit 816 as illustrated by solid line arrows 922 and 924.

The third conduit may be coupled at each of the first and second conduits through a double-elbow fitting.

The first conduit may supply fluid to the fluid dispense head and the second conduit may receive fluid from the fluid dispense head.

In an example of the disclosure for print applications, the fluid dispense head comprises a print head and the fluid comprises a print fluid. Examples of the disclosure may be used with print fluids such as latex print fluids which are degassed, and the print fluid jet print heads rely on the print fluids not including any air to avoid damage to the print head filter.

An example of the disclosure is a printer comprising fluid supply apparatus as disclosed.

Examples of the disclosure will now be described in the context of a printer and apparatus for a printer, by way of illustrative example. In the described example like parts may be indicated in the drawings using like reference numerals.

In an example of the disclosure illustrated in FIG. 1 a printer 100 has a chassis 102 which supports a print head, shown in FIG. 1 without print head inserted, and a fluid interconnect holder 109. The fluid interconnect forms a part of print fluid supply apparatus of the disclosure. The printer 100 utilises a recirculating print fluid delivery system which comprises print fluid conduits 106, 108. In the described disclosure the print fluid conduit 106, 108 respectively comprises a flexible hollow plastics tube. Print fluid conduit 106 provides a print fluid pathway to print fluid interconnect tower 114 (FIG. 5) which provides a print fluid pathway between the print fluid conduit 106 and a print head when the print head is inserted in chassis 102. Print fluid conduit 108 is in fluid communication with a second print fluid interconnect tower conduit branch 112 to provide a fluid pathway between a print head and print fluid conduit 108 via the second print fluid interconnect tower and conduit branch 112. A fluid interconnect bridge extends between print supply conduit 106 and print fluid conduit 108 and is supported by the fluid interconnect holder 109.

Figure 2:
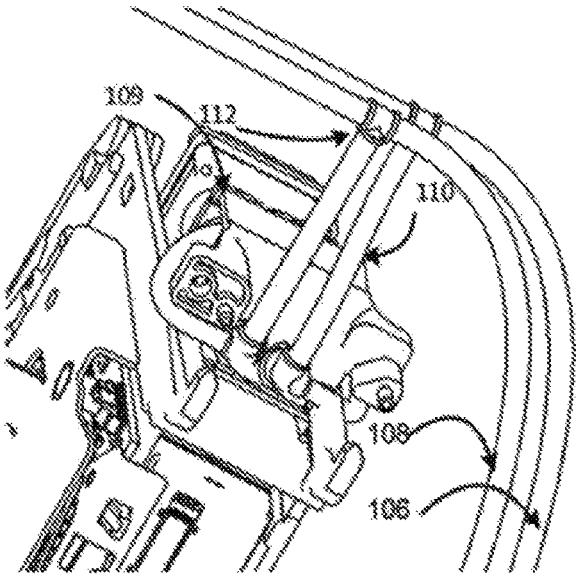
FIG. 2 is a schematic illustration of the example of the fluid supply apparatus with an interconnect bridge in situ with a print head from a second perspective.

Chassis 102 is illustrated from another perspective in FIG. 2 and like numerals indicate like parts of FIG. 1.

Figure 3:
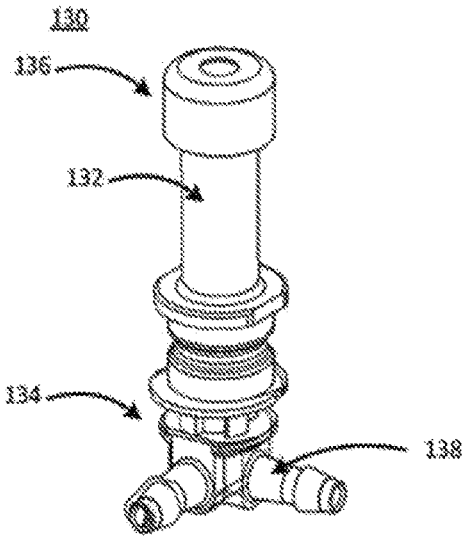
FIG. 3 is a schematic illustration of a fluid interconnect tower of the example of the fluid supply apparatus.

An example of a fluid interconnect tower 130 suitable for the present disclosure is illustrated in FIG. 3. The fluid interconnect tower 130 provides a conduit 132 for print fluid to and from a print head 103 (FIG. 4) and provides a suitable interface at the upper end, 136, to the print head 103. In the present example, the upper end 136 comprises septums where the print head needles are inserted. A print fluid conduit, for example print fluid supply conduit 106 or print fluid conduit 108, may be coupled at the lower end 134 to one port of the double-elbow fitting 138. The other port of the double-elbow fitting 138 is coupled to an end of a fluid interconnect bridge.

Figure 4:
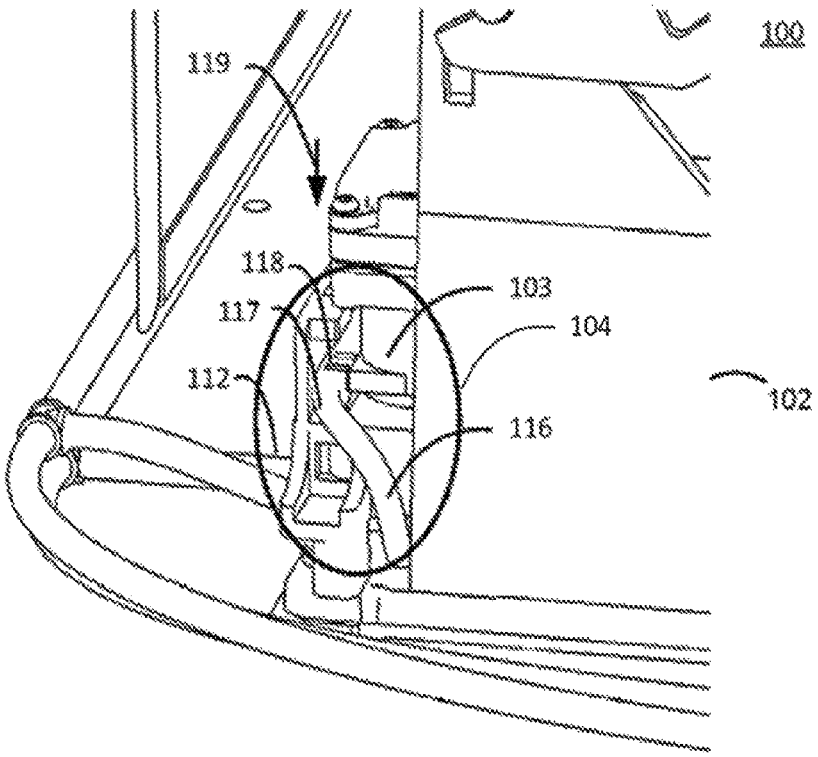
FIG. 4 is a schematic illustration of the example of the fluid supply apparatus from a side view with the print head inserted and interconnect tube is closed.

FIG. 4 illustrates a printer incorporating an example of a fluid supply apparatus in accordance with the present disclosure. The print fluid supply apparatus 104 is shown circled in the drawing. Print fluid conduits 106, 108 of the recirculating print fluid delivery system respectively comprise a flexible hollow plastics tube. Print fluid supply conduit 106 supplies print fluid to print fluid interconnect tower 114 via conduit branch 110 (FIG. 1). Print fluid interconnect tower 114 will provide a print fluid conduit to a print head 103 when inserted in the print head's operational position in chassis 102. Print fluid conduit 108 receives print fluid from a second print fluid interconnect tower, not shown, via fluid conduit branch 112, to drain print fluid from a print head 103 when inserted in the chassis 102. A fluid interconnect bridge 116 is formed of a hollow flexible plastics tube and provides a fluid conduit between the base of print fluid supply interconnect tower 114 to a corresponding position on the print fluid drain interconnect tower through which print fluid may return from a print head 103 inserted in the chassis 102, and into conduit branch 112 to print fluid conduit 108. Fluid interconnect bridge 116 is coupled to respective spare ports on the double-elbow fittings coupled to the lower end of fluid interconnect tower. In this way, print fluid may be circulated through the print fluid recirculating delivery system when the print head 103 is not inserted in the chassis 102 of the printer 100.

The fluid interconnect bridge 116 extends between print fluid supply interconnect tower 114 and print fluid drain interconnect tower through a region 117 in which the colour keys, 118, of the print head 103 are shown compressing the fluid interconnect bridge 116 tube. The present disclosure is described using a printer which has print heads each of which has a so-called colour key of a geometry corresponding to the colour of the print fluid the print head is to dispense. The different keys, depending on the colour of the print fluid to be dispensed by the print head, may prevent a print head from being inserted in the wrong slot of the printer (this may be similar to the strategy used for ink cartridges in order to prevent a user from inserting an incorrect cartridge, for example, the black print fluid cartridge in the cyan slot). Likewise, in the present disclosure the colour keys may only allow, for example, the white print head to be inserted in the correct slot for the white print fluid print head.

Arrow 119 shows the direction of travel of colour keys 118 when the print head 103 is inserted into the chassis 102. The colour keys, 118, compress the flexible plastics tubing of the fluid interconnect bridge 116 such that the tube walls deform to occlude and block the fluid conduit provided by the fluid interconnect bridge 116 and stop the passage of print fluid through the fluid interconnect bridge 116. In this way, print fluid may be directed through the supply interconnect tower 114 to the print head 103 and subsequently drained from the print head 103 through the drain interconnect tower and back into the recirculating print fluid system. Thus the print fluid may be recirculated through the print head 103 when it is inserted in the chassis in its operational position.

Figure 5:
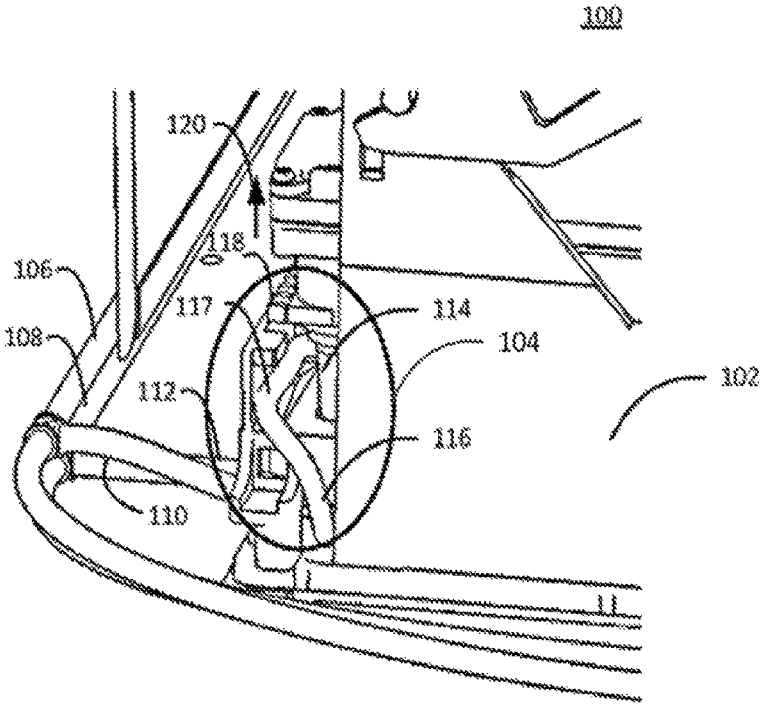
FIG. 5 is a schematic illustration of the example of the fluid supply apparatus from a side view with the print head removed and interconnect tube is open.

FIG. 5 illustrates an example of the print fluid supply apparatus of the disclosure while the print head 103 is displaced from its operational inserted position in the chassis 102. The colour keys 118, are shown displaced away from the fluid interconnect bridge 116 tube which releases its deformation so that it is open and print fluid may flow through it. Arrow 120 shows the direction of travel of the colour keys 118 when the print head 103 is being removed from the chassis 102.

Figure 6:
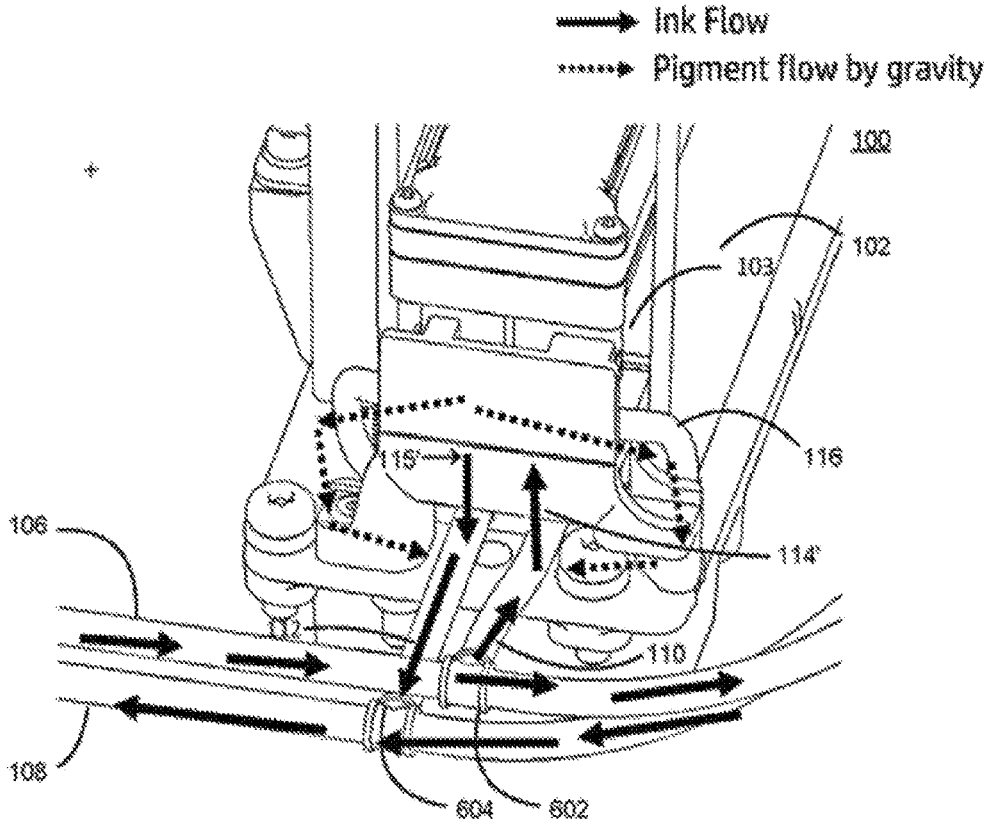
FIG. 6 is a view of the example of the fluid supply apparatus illustrating the direction of fluid flow when the print head is inserted and the interconnect tube is closed.
Figure 7:
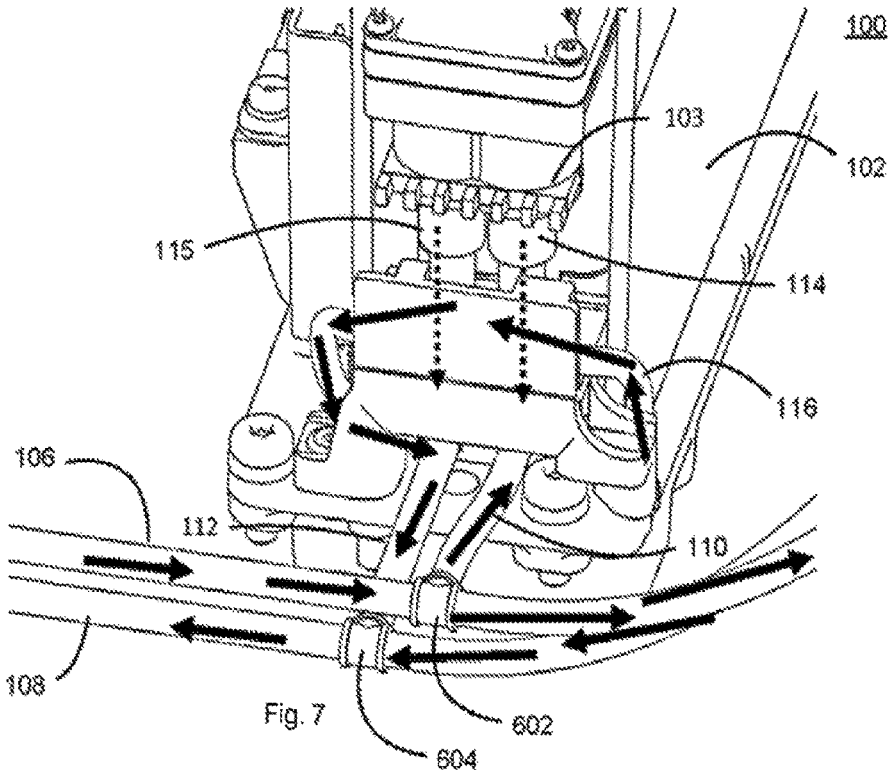
FIG. 7 is a view of the example of the fluid supply apparatus illustrating the direction of fluid flow when the print head is removed and the interconnect tube is open.

Turning now to FIG. 6, a schematic illustration of print fluid flow and pigment flow is disclosed for a configuration in which the print head 103 is present in the chassis 102 in it operational position, in such a configuration, fluid interconnect tube 116 is compressed by the print head 103 or an element thereof such as the colour keys 118 (not shown) to close the fluid interconnect tube 116. In FIGS. 6 and 7 print fluid flow is shown using solid arrows and pigment flow, which may include print fluid as a pigment carrier at least, in broken arrows.

Ink flows to the print head 103 "in" in one tube, 106, and "out" in the other tube, 108, for macrorecirculation routines or "in" in both tubes, 106 and 108, for printing or servicing routines. In both the macrorecirculation routine and the printing or servicing routines cases, the fluid interconnect tube 116 is pinched closed by the print head colour keys 118 so the two fluid interconnect towers, 114 and 115 in FIG. 7, are not connected, that is to say not in fluid communication with each other through the fluid interconnect 116. Closure of the fluid interconnect 116 causes print fluid to flow or recirculate through the print head 103. Print fluid flow through interconnect towers 114 and 115 to the print head 103 is illustrated in FIG. 6 by references 114' and 115' indicative of the print fluid flow even though the interconnect towers are not visible in the figure.

The print fluid flow shown in FIG. 6 is via tube 106 and though interconnect 602 to branch tube 110 and into interconnect tower flow 114'. At least some of the print fluid may flow through the interconnect 602 and continue to flow in tube 106. The print fluid flow is shown in FIG. 6 to return from the print head 103 in flow direction 115' into branch tube 112 through interconnect 604 and to tube 108.

As illustrated by the broken arrows in FIG. 6, fluid interconnect tube 116 comprises a single highest point to descend in a ramp like manner ramp to the double-elbow fitting 130 at the base of respective interconnect towers 114 and 115. This configuration may encourage pigment and print fluid to descend to the elbow-fitting 130 under the influence of gravity, as indicated by the broken lines, and avoid pigment settling in fluid interconnect tube 116. Pigment reaching respective elbow-fittings 130 will tend to be mixed with print fluid facilitated by the continuous flow of the print fluid. Hence, the print fluid in the tubes, or at least a part of it, will be recirculated and pigment will tend not to settle in the system.

FIG. 7 illustrates an example when the print head 103 is removed from its operational position and the fluid interconnect tube 116 is released so that it is open and print fluid may flow through it. In this example, print fluid tends not to flow through the fluid interconnect towers 114 and 115 that couple print fluid to the print head 103. In this example, the pigment tends to flow down through the fluid interconnect towers 114 and 115 to respective double-elbow fittings 130 due to the influence of gravity, as indicated by the broken lines. At the double-elbow fittings 130 the pigment tends to be dispersed due to print fluid flow through branch tubes 110 and 112 as well as through the fluid interconnect tube 116.

The described example may permit the print head to be removed from the printer and avoid damage to the print fluid delivery system as there may be print fluid flow through the system whether or not the print head is present. Removing print heads used with so-called heavy print fluids including pigmentation which may agglomerate permits service of the print heads servicing while reducing print fluid waste compared to other approaches avoiding pigment accumulation on the printer nozzles.

The teaching of disclosure may be useful for print heads with heavy print fluid pigments (such as white print fluid). These print heads may undergo long-time storage involving removing them from the printer to reduce both waste of print fluid and the risk of having print nozzles being blocked by the heavy print fluid pigment.

As used herein any reference to "one example" or "an example" or like terms or phrases means that a particular element, feature, structure, or characteristic described in connection with the example is included in at least one example. The appearances of the phrase or "in one example" or "in an example" or the like terms or phrases in various places in the specification are not necessarily all referring to the same example.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present). A is false (or not present) and B is true (or present), and both A and B are true (or present).

In addition, use of the "a" or "an" are employed to describe elements and components of the disclosure or an example. This is done merely for convenience and to give a general sense of the disclosure. This description should be read to include one or at least one and the singular also includes the plural unless it is obvious that it is meant otherwise.

In view of the foregoing description various modifications may be made within the scope of the disclosure. For example, a material other than a plastics material may be used to form the deformable walls of the fluid interconnect bridge. Such a material should be impervious to the printing fluid or fluids to be used and to have a structure such that a wall of a hollow tube conduit made from the material may be deformed to occlude the tube by a force that may be provided by a print head when it is inserted in a print head carriage. Additionally, although the disclosure has been described with reference to heavy print fluids the disclosure may be applied to using other print fluids or fluids. The teaching and general concept disclosed herein is not limited to printers or printing technology. The use of a print head colour keys to compress and deform the fluid interconnect bridge is an example of a part of the print head which may be used to deform the fluid interconnect bridge. Other parts of the print head may be used additionally or instead of the colour keys.

The scope of the present disclosure includes any novel feature or combination of features disclosed therein either explicitly or implicitly or any generalisation thereof irrespective of whether or not it relates to the claimed subject matter or mitigate against any or all of the issues addressed by the present disclosure. The applicant hereby gives notice that new claims may be formulated to such features during prosecution of this application or of any such further application derived therefrom. In particular, with reference to the appended claims, features from dependent claims may be combined with those of the independent claims and features from respective independent claims may be combined in any appropriate manner and not merely in specific combinations enumerated in the claims.

The invention claimed is:

1. A fluid supply apparatus comprising:

a first conduit to provide a first fluid communication pathway to a fluid dispense head when the fluid dispense head is engaged to the fluid supply apparatus;

a second conduit to provide a second fluid communication pathway to the fluid dispense head when the fluid dispense head is engaged to the fluid supply apparatus; and a closable third conduit to couple the first conduit and the second conduit together to permit a fluid flow between the first conduit and the second conduit, wherein the third conduit comprises deformable walls movable towards each other when the fluid dispense head is engaged to the fluid supply apparatus and compresses the third conduit, to close the third conduit to a passage of fluid between the first conduit and the second conduit through the third conduit, and wherein the deformable walls of the third conduit are released when the fluid dispense head is disengaged from the fluid supply apparatus, to open the third conduit to the passage of fluid between the first conduit and the second conduit through the third conduit.

2. The fluid supply apparatus of claim 1, wherein the fluid supply apparatus is engageable with the fluid dispense head to supply the fluid to the fluid dispense head in a fluid supply configuration, and wherein in the fluid supply configuration a wall of the deformable walls is deformed responsive to a part of the fluid dispense head engaging the wall to close the third conduit to the passage of fluid.

3. The fluid supply apparatus of claim 2, wherein the fluid supply apparatus is disengageable from the fluid dispense head to a non-fluid supply configuration to release the wall of the deformable walls.

4. The fluid supply apparatus of claim 1, wherein the third conduit is coupled to lower ends of the first and second conduits in an operational orientation where the third conduit is closed by the fluid dispense head.

5. The fluid supply apparatus of claim 1, wherein the third conduit traverses a path between the first and second conduits comprising a single high point in an operational orientation where the third conduit is closed by the fluid dispense head.

6. The fluid supply apparatus of claim 1, wherein the third conduit is coupled to each of the first and second conduits through a double-elbow fitting.

7. The fluid supply apparatus of claim 1, wherein the first conduit is to supply the fluid to the fluid dispense head, and the second conduit is to receive the fluid from the fluid dispense head.

8. The fluid supply apparatus, of claim 1, wherein the fluid dispense head comprises a print head, and the fluid comprises a print fluid.

9. The fluid supply apparatus of claim 1, wherein the third conduit comprises a tube that is compressed to close the third conduit when the fluid dispense head is engaged to the fluid supply apparatus and presses against the tube, and that is uncompressed to open the third conduit when the fluid dispense head is disengaged from the fluid supply apparatus.

10. The fluid supply apparatus of claim 9, wherein the tube is a plastic tube.

11. A method of supplying fluid to a fluid dispense head, the method comprising:

providing respective fluid communication pathways to the fluid dispense head through a first fluid conduit and a second fluid conduit;

coupling the first fluid conduit and the second fluid conduit via an interconnect conduit comprising deformable walls;

deforming a wall of the interconnect conduit responsive to a movement of the fluid dispense head to an engaged position to be in fluid communication with the first and second fluid conduits, the fluid dispense head compressing the wall when the fluid dispense head moves to the engaged position and closing the interconnect conduit to a passage of fluid between the first and second fluid conduits through the interconnect conduit; and releasing the wall of the interconnect conduit responsive to a movement of the fluid dispense head to a disengaged position at which the fluid dispense head is not in fluid communication with the first and second fluid conduits, the releasing of the wall of the interconnect conduit opening the interconnect conduit to allow the passage of fluid between the first and second fluid conduits through the interconnect conduit.

12. The method of claim 11, further comprising coupling the interconnect conduit to lower ends of the first fluid conduit and the second fluid conduit.

13. The method of claim 11, further comprising configuring the interconnect conduit to have a single high point relative to the first fluid conduit and the second fluid conduit when the interconnect conduit is closed.

14. The method of claim 11, wherein the first fluid conduit is to supply the fluid to the fluid dispense head, and the second fluid conduit is to receive the fluid from the fluid dispense head.

15. The method of claim 11, wherein the interconnect conduit comprises a tube that is compressed to close the interconnect conduit when the fluid dispense head is in the engaged position, and that is uncompressed to open the interconnect conduit when the fluid dispense head is in the disengaged position.

16. A system comprising:

a chassis to removably receive a fluid dispense head; and a fluid supply apparatus supported by the chassis, the fluid supply apparatus comprising:

a first conduit to provide a first fluid communication pathway to a fluid dispense head when the fluid dispense head is engaged to the fluid supply apparatus, a second conduit to provide a second fluid communication pathway to the fluid dispense head when the fluid dispense head is engaged to the fluid supply apparatus, and a closable third conduit to couple the first conduit and the second conduit together to permit a fluid flow between the first conduit and the second conduit, wherein the third conduit comprises deformable walls movable towards each other when the fluid dispense head is engaged to the fluid supply apparatus and compresses the third conduit, to close the third conduit to a passage of fluid between the first conduit and the second conduit through the third conduit, and wherein the deformable walls of the third conduit are released when the fluid dispense head is disengaged from the fluid supply apparatus, to open the third conduit to the passage of fluid between the first conduit and the second conduit through the third conduit.

17. The system of claim 16, wherein the third conduit comprises a tube that is compressed to close the third conduit when the fluid dispense head is engaged to the fluid supply apparatus and presses against the tube, and that is uncompressed to open the third conduit when the fluid dispense head is disengaged from the fluid supply apparatus.

18. The system of claim 17, wherein the tube is a plastic tube.

* * * * *